United States Patent [19]

Duffy

[11] Patent Number: 4,795,033

[45] Date of Patent: Jan. 3, 1989

[54] PACKAGING AND STORAGE CONTAINER

[76] Inventor: John F. Duffy, 8625 Braeburn, Beaumont, Tex. 77707

[21] Appl. No.: 72,016

[22] Filed: Jul. 10, 1987

[51] Int. Cl.[4] ..... B65D 85/34

[52] U.S. Cl. ..... 206/457; 206/524.1; 206/525; 220/4 B; 220/352; 426/104; 426/112

[58] Field of Search ..... 206/524.1, 525, 527, 206/457; 150/55; 220/4 B, 4 E, 352–356; 426/104, 110, 112, 124, 383, 394

[56] References Cited

U.S. PATENT DOCUMENTS

| | | | |
|---|---|---|---|
| D. 248,280 | 6/1978 | Martin . | |
| D. 249,241 | 9/1978 | Halleron . | |
| D. 253,516 | 11/1979 | Meierhoefer . | |
| D. 254,650 | 4/1980 | Fenton . | |
| D. 277,234 | 1/1985 | Bank . | |
| D. 277,295 | 1/1985 | Jones . | |
| D. 277,364 | 1/1985 | Nightingale . | |
| D. 279,258 | 6/1985 | Curtis . | |
| D. 281,145 | 10/1985 | Moe . | |
| D. 281,225 | 11/1985 | Leman . | |
| D. 281,226 | 11/1985 | Amabili . | |
| D. 281,400 | 11/1985 | Fortuna . | |
| D. 281,673 | 12/1985 | Lampe . | |
| D. 283,790 | 5/1986 | Lemkin et al. . | |
| 2,452,174 | 10/1948 | Arnold | 426/106 |
| 2,818,166 | 12/1957 | Hill . | |
| 2,819,813 | 1/1958 | Larsen . | |
| 2,850,153 | 9/1958 | Cosentino . | |
| 2,918,379 | 12/1959 | Lurie . | |
| 2,941,708 | 6/1960 | Crane et al. . | |
| 3,167,104 | 1/1965 | Wiley et al. . | |
| 3,233,812 | 2/1966 | Kennedy . | |
| 3,236,410 | 2/1966 | Swartz . | |
| 3,418,139 | 12/1968 | Craig | 426/124 |
| 3,451,540 | 6/1969 | Kulischenko . | |
| 3,458,079 | 7/1969 | Gasbarra | 150/55 |
| 3,563,370 | 2/1971 | Nozette et al. . | |
| 3,938,691 | 2/1976 | Dumas | 220/356 |

FOREIGN PATENT DOCUMENTS

| | | | |
|---|---|---|---|
| 0043407 | 8/1960 | Poland | 220/355 |

*Primary Examiner*—Jimmy G. Foster

*Attorney, Agent, or Firm*—Burns, Doane, Swecker & Mathis

[57] ABSTRACT

A container for edible materials such as fruits and vegetables is fashioned in two parts from low density polyethylene material. A joint is provided between the two parts which allows the parts to be separated while the contents are inserted or used, and to then be reclosed. The joint may be a simple frictional connection, but the joint may also include and interference type of connection. The two parts define an internal cavity which is sized to accommodate individual pieces of fruit or vegetable such as citrus fruit like lemons and limes, yellow onions, tomatoes, leafy vegetables like lettuce an cabbage, squash, cucumbers, carrots, green onions, and celery.

17 Claims, 6 Drawing Sheets

Fig. 2
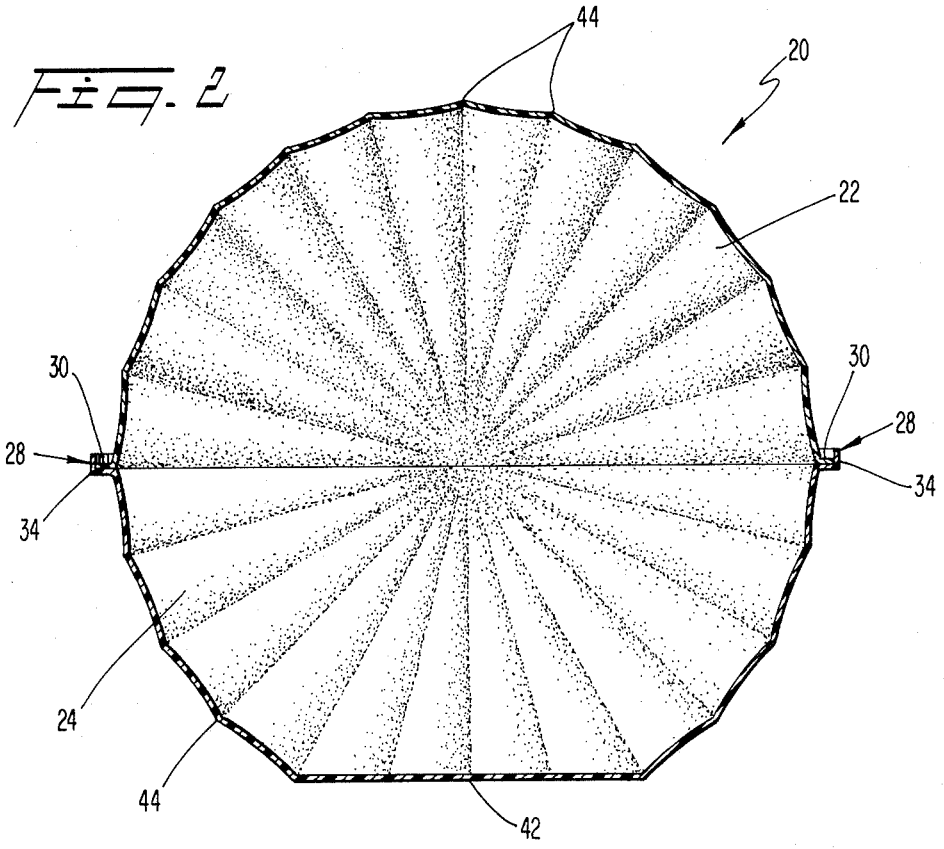
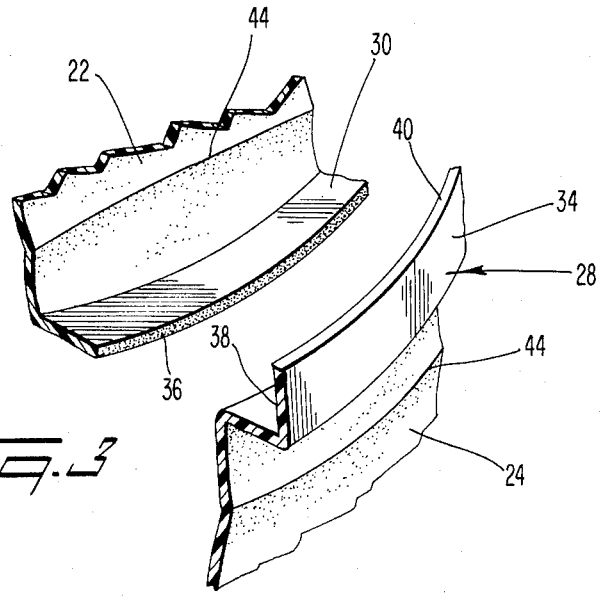
Fig. 3

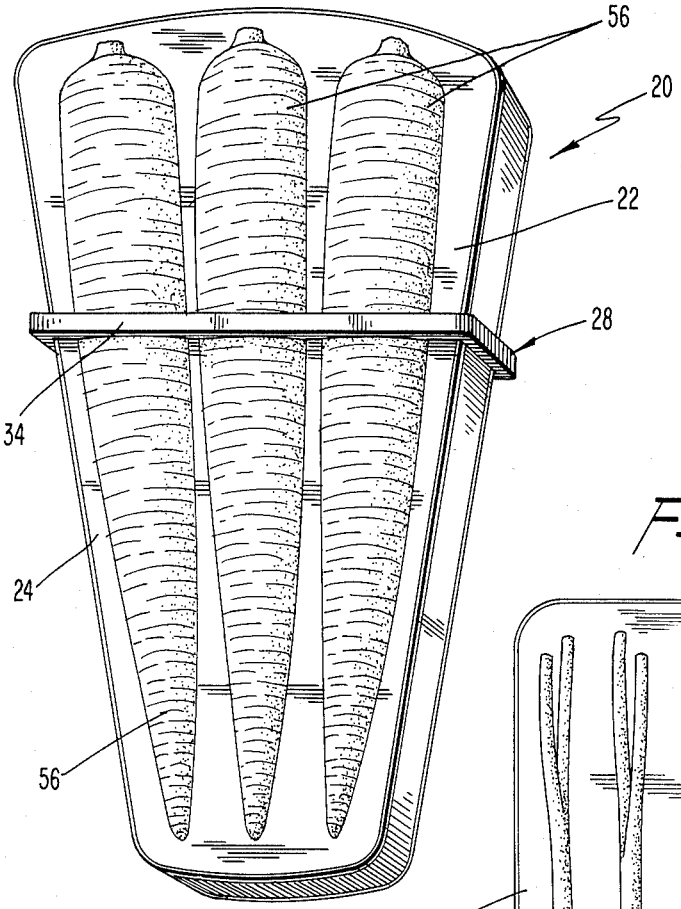
FIG. 9
FIG. 10
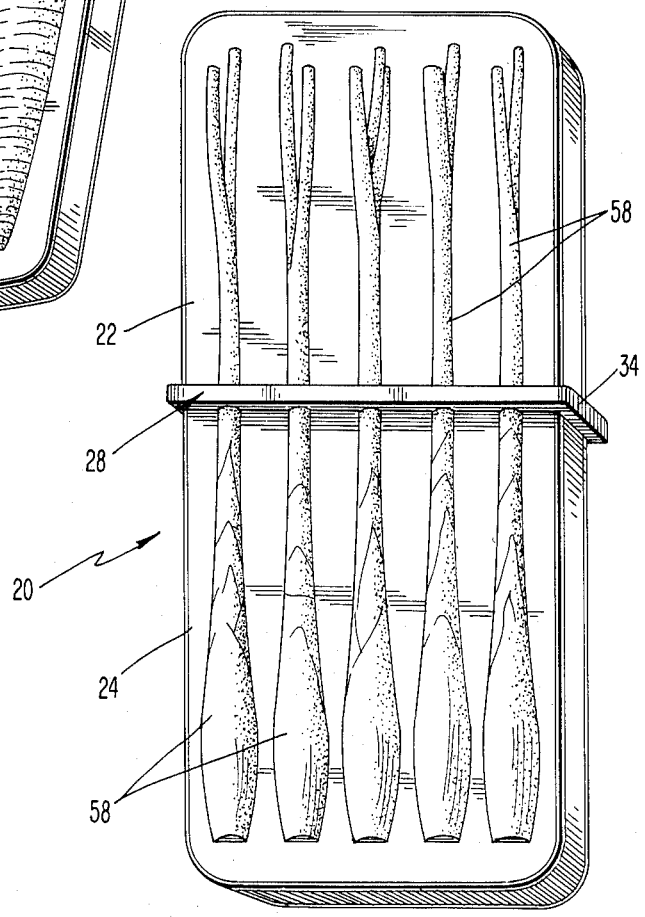

PACKAGING AND STORAGE CONTAINER

BACKGROUND OF THE INVENTION

The present invention relates generally to containers for packaging and storing edible materials. More particularly, the present invention relates to a container for packaging and storing fruits and vegetables.

In connection with the harvesting, distribution, retail, and consumption of fruits and vegetables, there are a variety of problems which have manifested themselves. For example, during harvesting, fruits and vegetables are often placed in large containers for shipment to distributors. The distributors then clean the edible materials, as necessary, and ship those edible materials to various retail outlets. At the retail outlet, the vegetables are sometimes packaged into smaller disposable containers but are sometimes offered for sale as loose items.

The known containers which have been used for fruits and vegetables generally are not reclosable and do not offer physical structure to protectively support individual perishable items during handling, transit, and retail sale. Typically, these containers comprise crates, corrugated boxes and the like.

At the point of retail sale, a variety of packaging systems and materials are used. Frequently, vegetables are displayed in a loose condition on a shelf so that a purchaser can select the individual items. In this instance, the purchaser typically uses a clear plastic bag to hold the items during the remainder of the shopping trip and until the items arrive at the shopper's home.

Citrus fruits are sometimes offered for retail sale in mesh bags or relatively heavy plastic bags. While these bags offer convenient transportation, they are not reclosable and do not provide a container that protects the fruit from physical damage during transportation to the ultimate destination, the home. Moreover, the bags do not offer storage capability at the shopper's home.

Some fruits, such as grapes and apples, are prepackaged and offered for retail sale in plastic, or cardboard trays which are covered by clear plastic wrap. Such containers are convenient where the fruit is being sold in prepackaged lots by weight or by number of items. However, such containers are neither reusable nor reclosable.

To preserve edible materials such as fruit and vegetables after retail purchase, the consumer typically refrigerates them. With the frost-free refrigerators that are almost universally used in this country, another category of problems occurs which adversely affect these edible materials. For example, frost-free refrigerators continually circulate air through the refrigeration compartment which dehydrates fruit and vegetables. Additionally, frost-free refrigerators, as well as older non-frost-free refrigerators, allow food odors to permeate other foods stored in the refrigerator. These problems of drying and odor absorption deleteriously affect the useful life of edible materials such as fruits and vegetables.

Accordingly, it is seen that the need continues to exist for a new and improved packaging and storage container which overcomes problems of the type discussed herein.

SUMMARY OF THE INVENTION

It is, therefore, a general object of this invention to provide a packaging and storage container for edible materials which overcomes problems of the type discussed above.

It is a more particular object of the present invention to provide a container which generally conforms to the shape of the edible material which it contains so as to provide protection from physical damage to perishable material such as fruit or vegetables.

It is another object of the present invention to provide a container for edible material which can serve as a shipping container, as well as a point of sale display container and a food storage container.

Yet another object of the present invention is to provide a container for edible material which is reclosable so that it can be reused and so that its contents can be consumed a bit at a time.

A packaging and storage container which meets the foregoing objectives may, for example, have a pair of container portions which define a cavity that generally conforms to the exterior shape of a particular fruit or vegetable to be packaged or stored. Each container portion is preferably fabricated from low density polyethylene and is textured to conform to the fruit or vegetable to be packaged. In this way the container has a shape which readily identifies the edible material contained therein.

By further providing one container portion with a lip and the other container portion with a cooperating flange, the two container portions can be opened to inspect the contents and reclosed. Moreover, the resulting container can be reused by the consumer, if desired. If the container portion having the flange is roughened on the peripheral surface surrounding the flange, then the additional frictional engagement between the container portions when assembled resists accidental separation of the container portions. Moreover, the container can thus provide a more effective vapor seal to contain moisture in the edible material and to retard emission of offensive odors (as in the case of onions) while retarding absorption of other odors from a refrigeration compartment.

One of the container portions may have a generally flattened surface. Such a generally flattened surface would be highly useful in the case of generally spherical fruits or vegetables such as tomatoes, onions, citrus fruits like grapefruits, oranges, lemons and limes, or leafy head vegetables like lettuce and cabbage.

Where the fruit or vegetable has an elongated shape, such as in the case of cucumbers, carrots, celery, or green onions, then the two container portions may be in the shape of plate-like trays having depressions sized to conform to the particular fruit or vegetable which is to be packaged therein.

BRIEF DESCRIPTION OF THE DRAWINGS

Many objects and advantages of the present invention will be apparent to those skilled in the art when this specification is read in conjunction with the drawings wherein like reference numerals are applied to like elements and wherein:

FIG. 2 is a cross-sectional view taken along the line 2—2 of FIG. 1;

FIG. 3 is an enlarged detail view of the engagable edge portions of the embodiment of FIG. 1;

FIG. 9 is a perspective view of a packaging and storage container for carrots;

FIG. 10 is a perspective view of a packaging and storage container for green onions.

DESCRIPTION OF THE PREFERRED EMBODIMENTS

A packaging and storage container according to the present invention is preferably fashioned to completely surround and enclose the piece or fruit or vegetable which it is intended to package. It should be clear that, being items of nature, there is no absolute uniformity of dimensions for pieces of fruit or vegetables. With this in mind, it will be understood that the containers according to this invention must be sized to accept the average size and shape for a particular fruit or vegetable. Generally speaking, the average approximate sizes and dimensions for pieces of fruit and vegetables is known. This information is typically used in grading fruit and vegetables by size. To the extent that such average approximate sizes and dimensions are not known for a piece of fruit or vegetable for which it is desired to make packaging and storage containers, a simple statistical analysis of the particular fruit or vegetable can be performed to get the necessary sizes, dimensions, and shapes along with the ranges of variation from the average size or from preselected grading sizes.

Figure 1:
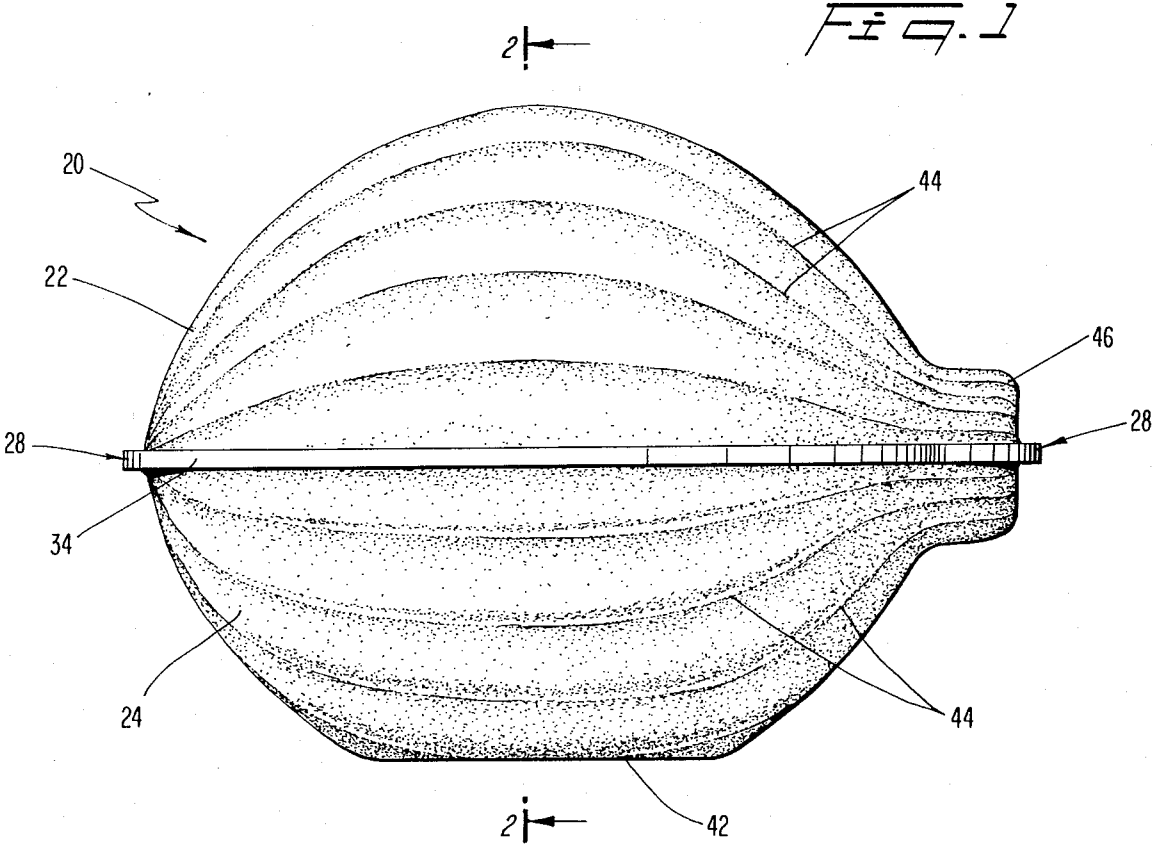
FIG. 1 is an elevational view of a packaging and storage container for an onion.

Using the information on size, dimension and shape, a packaging and storage container 20 (see FIG. 1) is prepared. The container 20 includes a first or top portion 22 and a second or bottom portion 24. These two portions 22, 24 cooperate to define a cavity 26 (see FIG. 2) therebetween. This cavity 26 is intentionally designed to conform to the typical shape of the fruit or vegetable to be packaged. Moreover, the cavity is sized and dimensioned so as to accommodate about 99% of the particular fruit or vegetable being packaged.

In this connection, it is also intended that the packaging and storage container 20 be sized so that the clearance between a piece of fruit or vegetable and the walls of the container 20 does not exceed about ⅜ inch when the piece of fruit or vegetable is approximately centered in the cavity 26. With this clearance, there should be relatively little room for movement of the fruit within the container and, therefore, little risk of physical damage to the fruit or vegetable during transit.

As a preferred material for making the container portions 22, 24 low density pliable polyethylene has been selected. Preferably, this material is used in a thickness of 0.024 inch. The material is preferred since it has uniform color, can be readily shaped and formed, and can be given a surface texture.

In order to gain access to the cavity 26, the container portions 22, 24 are provided with a joint 28 therebetween. Details of the joint 28 are best seen in FIG. 3. The first container portion 22 may be provided with a flange 30 which extends outwardly from the body of the container portion 22. The flange 30 is preferably continuous and extends completely around the first container portion 22. The flange 30 has a peripheral edge 36 which is suitably roughened to give enhanced frictional resistance. In addition, the peripheral edge 30 has a predetermined length.

The flange 30 of the first container portion 22 cooperates with a lip 34 on the second container portion 24. The lip 34 extends outwardly from the second container portion 24. Like the flange 30, the lip 34 is preferably continuous and extends completely around the second container portion 24. Along its outer edge, the lip 34 has an upstanding wall 38 which may be roughened on its interior surface. Thus the roughened interior surface of the wall 38 can cooperate with the roughened peripheral edge 36 of the flange 30 to frictionally hold the two container portions 22, 24 together.

If desired, the lip 34 can be designed so that the inside of the upper edge surface 40 has a length which is less than the predetermined length of the peripheral surface 36 of the flange 30. In this way, there is a slight interference fit between the two container portions 22, 24 at the joint 28 which augments the frictional connection therebetween.

Where the piece of fruit or vegetable has a generally spherical shape, one of the container portions 22, 24 can be provided with a substantially flattened portion 42 (see FIG. 2). That flattened portion 42 is operable to resist rolling when the packaging and storage container is placed on an inclined surface, as often happens in grocery store displays.

It is also preferred that the exterior of the container 20 be provided with characteristics of the fruit or vegetable to be packaged therein. For example, where the container is intended to hold an onion (see FIG. 1), the surface may be provided with a plurality of longitudinally extending ridges 44 so that the surface has a texture resembling the texture of an onion surface. Moreover, one end of the container 20 can blend into a truncated conical form 46, if desired.

Figure 4:
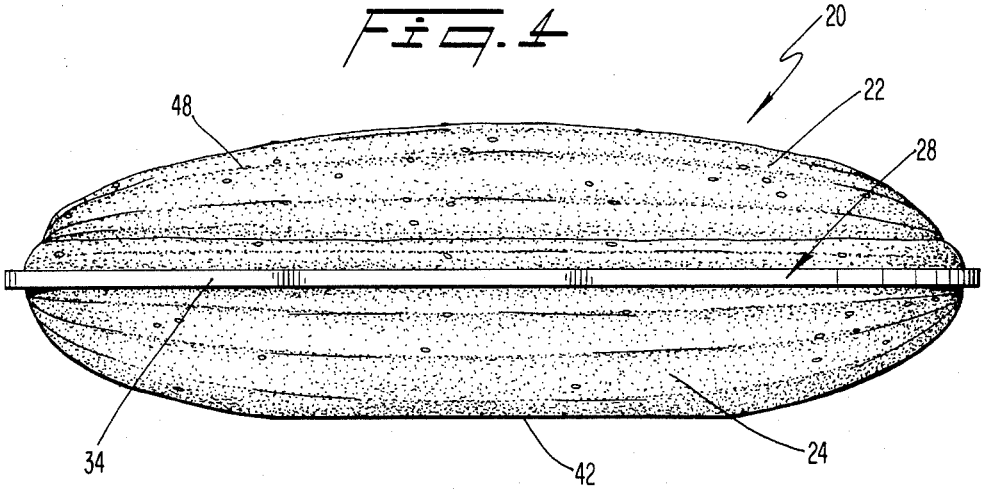
FIG. 4 is an elevational view of a packaging and storage container for an elongated vegetable.
Figure 5:
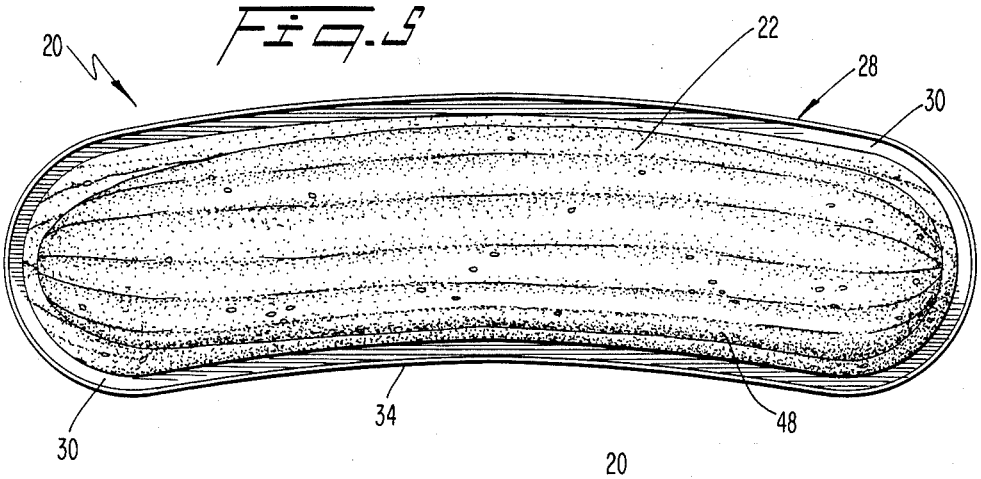
FIG. 5 is a plan view of the container similar to that of FIG. 4 suitable for a cucumber.

Clearly, no one shape will suffice for all the variety of fruits and vegetables. Thus it is also within the purview of this invention to provide a container 20 which is generally elongated (see FIG. 4). Such an elongated container might be suitable for packaging and storing zucchini squash or the like. Moreover, where the fruit or vegetable is not ordinarily straight, the container 20 may be curved as appropriate (see FIG. 5). Here again, the surface of the container portions 22, 24, can be provided with whisker-like stubble to resemble the texture of the fruit or vegetable item packaged therein.

Figure 6:
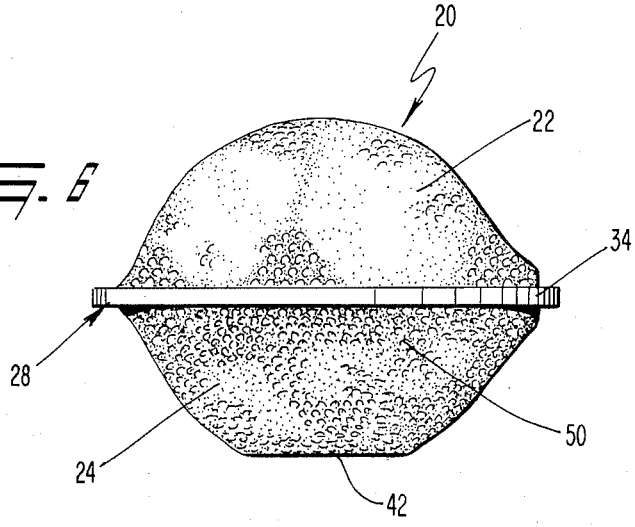
FIG. 6 is an elevational view of a packaging and storage container for a lemon or a lime.
Figure 7:
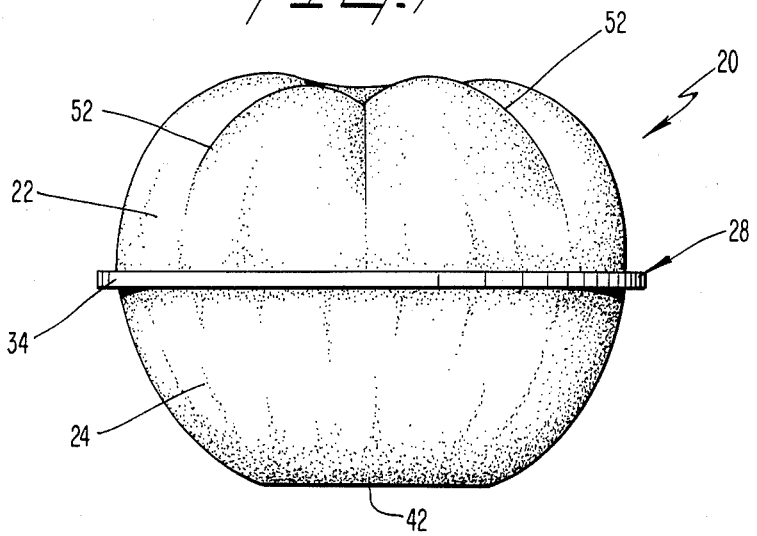
FIG. 7 is an elevational view of a packaging and storage container for a tomato.
Figure 8:
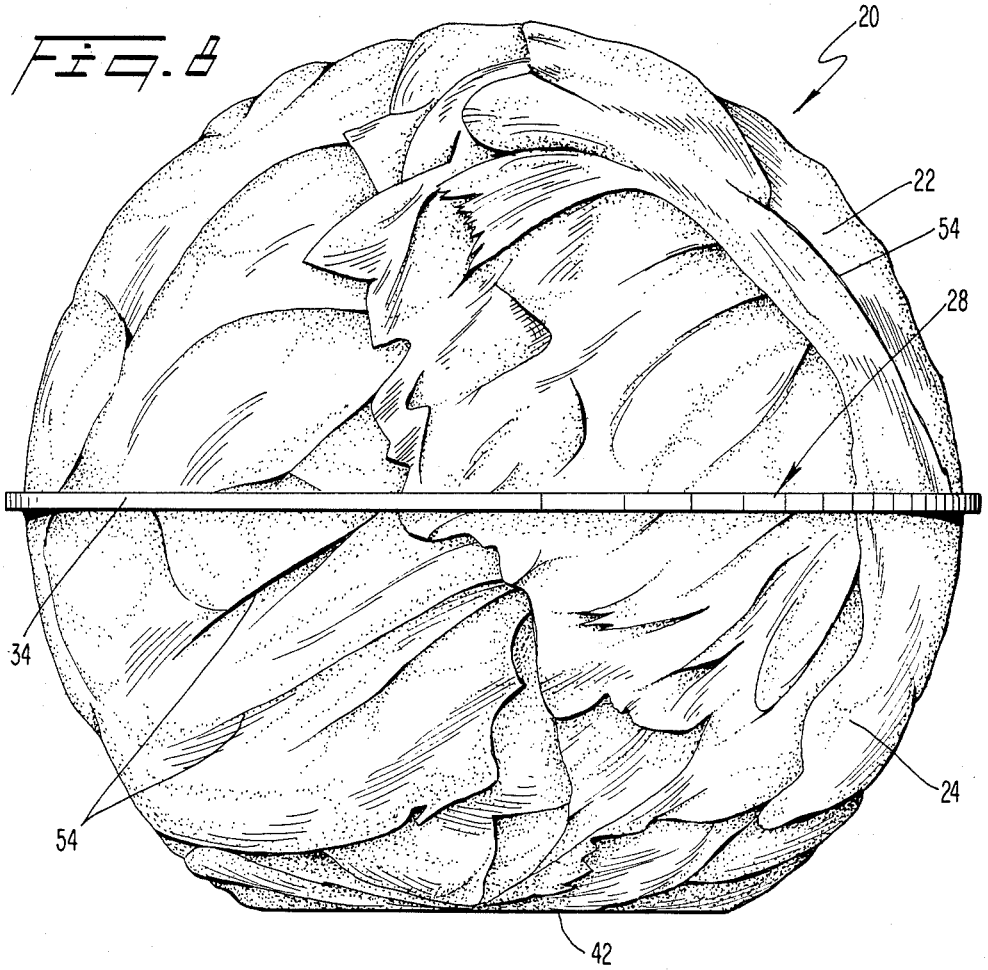
FIG. 8 is an elevational view of a packaging and storage container for a head of lettuce.

For packaging and storing items such as lemons or limes (see FIG. 6), the surface of the container 20 may be provided with randomly spaced dimples 50 to simulate the surface characteristics of the contents. For packaging and storing tomatoes (see FIG. 7) one of the container portions 22, 24 may be provided with several generally radially extending grooves emanating from the center of one container portion, e.g. 22. For larger items such as lettuce or cabbage (see FIG. 8), the container portions 22, 24 are preferably provided with a texture 54 resembling nested leaves, characteristic of the surface of lettuce or cabbage.

It is envisioned that some vegetable products, which are elongated with a relatively small transverse dimension (i.e., less than about 1.5 inches), may be packaged with several pieces to a container. Carrots, for example, fall within this category. A suitable container 20 for such objects may have a generally uniform thickness (see FIG. 9) and may be generally trapezoidal when viewed from the top. In this embodiment, however, rather than treating the entire surface of the container 20 so as to resemble the texture of the contents thereof, only the top surface is textured. Here the surface may have elongated convolutions 56 which are textured to resemble the contents. Such convolutions are also effective to provide tray-like areas to receive individual vegetable pieces.

Figure 11:
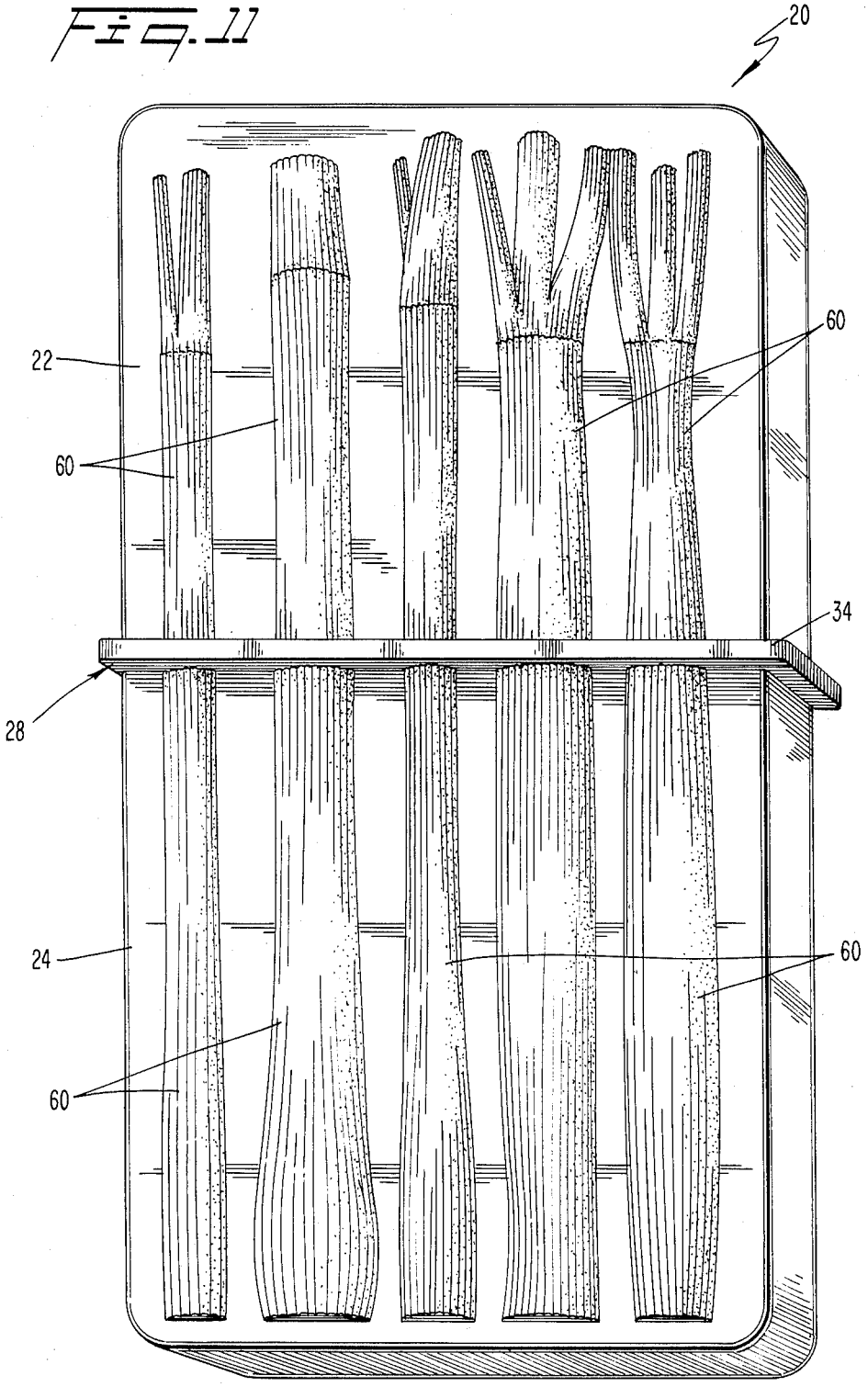
FIG. 11 is a perspective view of a packaging and storage container for celery.

Other vegetables such as green onions (see FIG. 10) and celery (see FIG. 11) may also be packaged in containers 20. For these items, however, the container is may be a generally rectangular box-like shape.

To make containers according to the present invention, it is only necessary to prepare appropriate molds. Thereafter, sheet stock can be fed to a molding machine having the molds and the container portions 22, 24 result. Alternatively, it is possible to make the container portions with injection molding apparatus.

In either event, the prepared container portions are then used to package pieces of fruit or vegetables. To this end, the container portions can be used in the field or orchard at the time the fruit or vegetable crop is harvested. Laborers would simply place each piece of fruit in its own container, and then close the container.

With the fruit or vegetable safely in the container, subsequent handling and shipment are facilitated. The container itself provides additional physical resistance to abrasion and impact damage.

Alternatively, the fruit or vegetable can be harvested in the same manner as has been done in the past. The harvested fruit or vegetable which is to be distributed for sale by grocery stores can the packaged in appropriate containers according to this invention. This packaging can be performed by the distributor, or by the retailing grocery store itself.

With fruit or vegetables packaged in containers of the type disclosed here, the containers can be displayed for the retail purchaser. The surface texture of the containers is useful to help identify the contents to persons that have impaired eyesight. In addition, the containers are not prone to roll from the grocery shelf when provided with the flattened bottom surface After purchase by a retail customer, when the fruit or vegetable is placed in a frost-free refrigerator, the continuous circulation of air which maintains the frost-free condition is shielded from the fruit or vegetable by the container. As a result, the contents of the container does not dry out nearly as rapidly. Furthermore, the container presents a barrier to odors in the refrigerator that might otherwise be absorbed by the container contents. Conversely, the container also presents a barrier to release of odors by its contents to the refrigeration compartment. Thus palatability of the fruit or vegetable is preserved for a longer period of time.

The joint 28 which connects the two container portions 22, 24 is reusable. Accordingly, where the contents of the container are only partially used, as in the case of an onion, the remaining portion of the onion can be replaced in its container and put back in the refrigerator without further packaging.

It should now be apparent that a new and useful packaging and storage container has been described which overcomes problems of the prior art and which provides advantages over the products which have been available in the past. Moreover, it will be apparent to those skilled in the art that numerous modifications, variations, substitutions, and equivalents exist for features of the invention which do not materially depart from the spirit and scope of this invention. Accordingly, it is expressly intended that all such modifications, variations, substitutions, and equivalents which fall within the spirit and scope of the appended claims be embraced thereby.

What is claimed is:

1. A container for a piece of predetermined edible material comprising:

a first container portion having a peripheral flange and an external texture resembling the texture of the predetermined edible material;

a second container portion having a peripheral lip and an external texture resembling the texture of the predetermined edible material, the first and second container portions cooperating to define a cavity sized to accommodate the predetermined edible material; and a connection joint between the first container portion and the second container portion defined by cooperation between the peripheral flange and the peripheral lip, at least one of the peripheral flange and the peripheral lip being roughened to increase the frictional resistance to separation at the joint;

wherein said container is resealable by means of said connection joint.

2. The container according to claim 1 wherein both the peripheral flange and the peripheral lip are roughened to increase the frictional resistance to separation at the joint.

3. The container according to claim 1 wherein the first container portion and the second container portion are fashioned from low density pliable polyethylene.

4. The container according to claim 1 wherein one of the first and second container portions has a flattened surface portion to resist rolling of the container.

5. The container according to claim 1 wherein the cavity is shaped to conform to an onion.

6. The container according to claim 1 wherein the cavity is shaped to conform to an elongated vegetable.

7. The container according to claim 6 wherein the cavity is shaped to conform to a cucumber.

8. The container according to claim 1 wherein the cavity is shaped to conform to a citrus fruit.

9. The container according to claim 8 wherein the cavity is shaped to conform to a lemon.

10. The container according to claim 1 wherein the cavity is shaped to conform to a tomato.

11. The container according to claim 1 wherein the cavity is shaped to conform to a head of a leafy vegetable.

12. The container according to claim 1 wherein the cavity is shaped to conform to a head of lettuce.

13. The container according to claim 1 wherein the peripheral flange has an edge with a predetermined length, the peripheral lip has a wall with a predetermined length which is less than the predetermined length of the peripheral flange.

14. A container for a predetermined edible material comprising:

a first container portion having a peripheral flange;

a second container portion having a peripheral lip;

one of the first and second container portions having an exterior surface at least a portion of which has a texture resembling the texture of the predetermined edible material;

the first and second container portions cooperating to define a cavity sized to accommodate the predetermined edible material; and a connection joint between the first container portion and the second container portion defined by cooperation between the peripheral flange and the peripheral lip, at least one of the peripheral flange and the peripheral lip being roughened to increase the frictional resistance to separation at the joint;

wherein said container is resealable by means of said connection joint.

15. The container according to claim 14 wherein the cavity is sized to accommodate carrots.

16. The container according to claim 14 wherein the cavity is sized to accommodate green onions.

17. The container according to claim 14 wherein the cavity is sized to accommodate celery.

* * * * *